United States Patent [19]

Codner

[11] 4,453,758

[45] Jun. 12, 1984

[54] PIPE LIFTING HOOK HAVING CLAMP ASSEMBLY

[76] Inventor: James H. Codner, 111 W. 38th, #301, Austin, Tex. 78705

[21] Appl. No.: 327,128

[22] Filed: Dec. 3, 1981

[51] Int. Cl.[3] ..... B66C 1/44

[52] U.S. Cl. ..... 294/104

[58] Field of Search ..... 294/104, 101, 36 R, 294/103 R, DIG. 1, DIG. 2, 102 RR, 106, 114, 116, 111, 112; 24/248 R, 248 B, 248 E, 250, 248 PS

[56] References Cited

U.S. PATENT DOCUMENTS 2,654,629 10/1953 Renfroe ..... 294/104

3,171,178 3/1965 Smith et al. ..... 294/104

FOREIGN PATENT DOCUMENTS 796153 1/1979 U.S.S.R. ..... 294/104

*Primary Examiner*—James B. Marbert

*Attorney, Agent, or Firm*—Gunn, Lee & Jackson

[57] ABSTRACT

A pipe lifting hook is provided having a generally "C" shaped hook member having an elongated lower portion being insertable within the end of a joint of pipe and having an upper portion positionable above the pipe and provided with lifting connection means. The hook member is frictionally clamped to the pipe by grip shoe means that is movably supported by the upper portion of the hook member and is selectably movable from a released position out of contact with said pipe to a locked position in frictional locking engagement with the outer surface of the pipe. A ratchet mechanism couples said grip shoe means to the upper portion of the hook member and is manually positionable to lock said grip shoe means at said locked position or release said grip shoe means for movement toward said released position thereof.

14 Claims, 3 Drawing Figures

FIG. 1
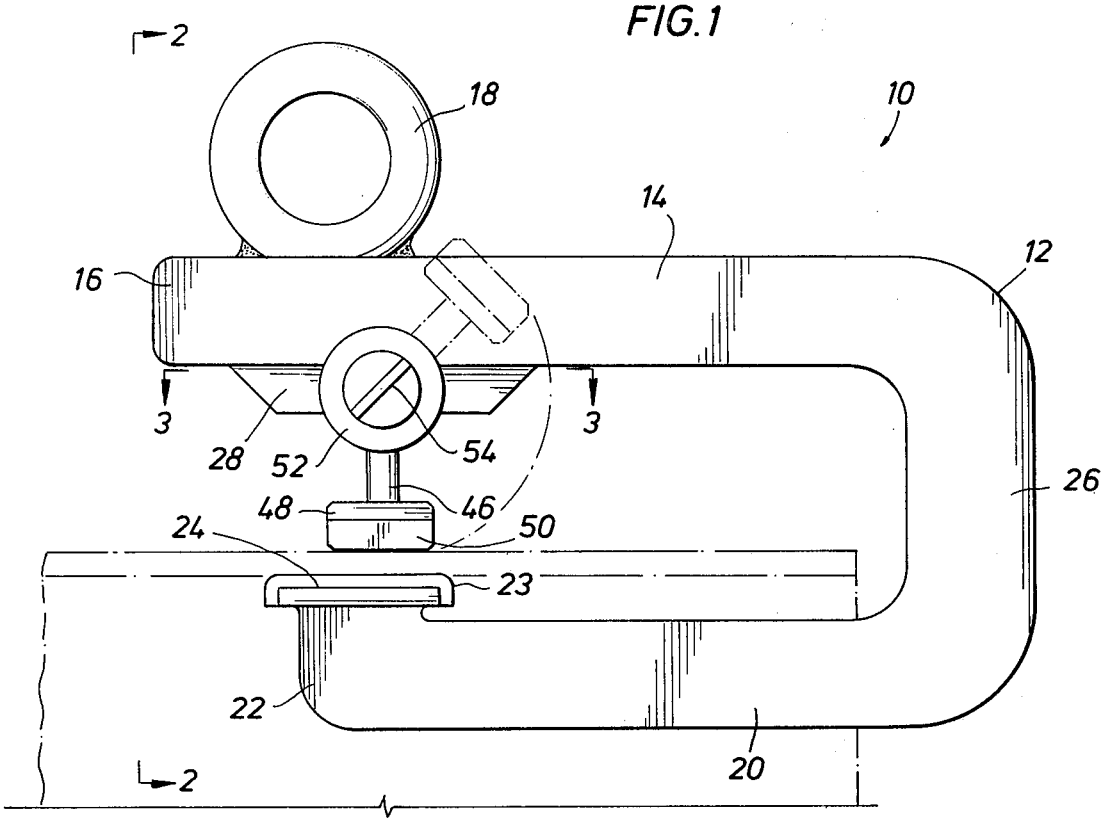
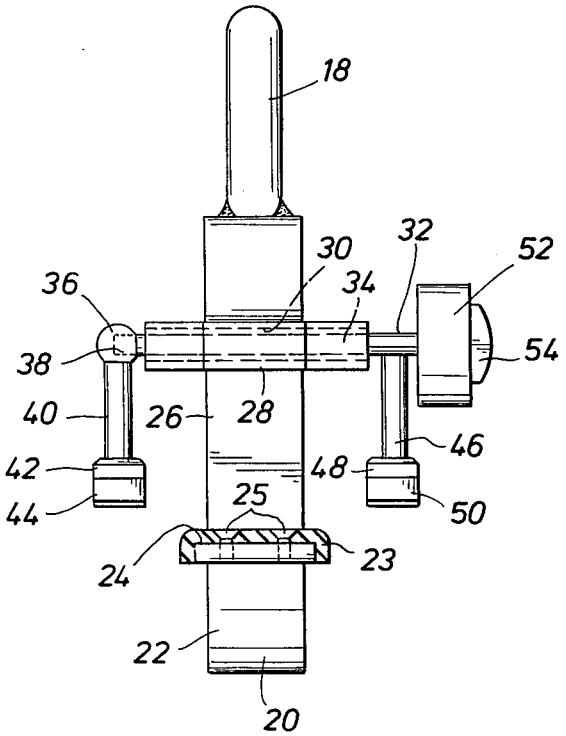
FIG. 2
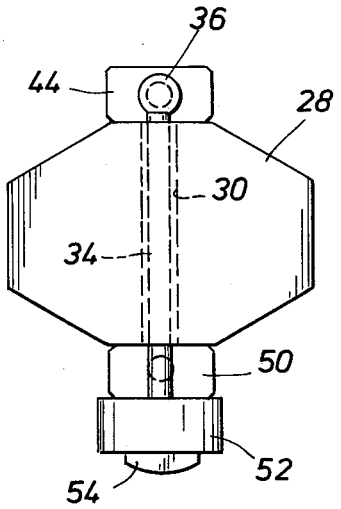
FIG. 3

PIPE LIFTING HOOK HAVING CLAMP ASSEMBLY

BACKGROUND OF THE INVENTION

1. Field of the Invention

This invention relates generally to pipe lifting and handling apparatus and more particularly to a clamping type hook mechanism capable of establishing releasable clamping engagement with the extremity of a joint of pipe to prevent inadvertent disassembly of the hook mechanism from the pipe when used in pairs to lift and handle sections of pipe.

2. Description of the Prior Art

While the present invention described herein is particularly in relation to lifting and handling joints of pipe, it is not intended that the invention be specifically limited to pipe joints. This invention is applicable to the lifting and handling of any elongated bar member and therefore the breadth of the invention is intended to include lifting and handling of elongated members such as pipes, structural members and the like. Especially in field environments such as when pipe is handled around well drilling sites, placed into or moved from various transportation systems, such as trucks, trains, pipe handling barges and the like, the pipe is typically lifted through use of a lifting bridle that extends from a lifting cable. The lifting bridle typically has two legs that extend from the lifting cable with a "C" shaped hook connected to each end of the bridle. The hooks are merely placed into the ends of joints of pipe such as drill stem, well casing and the like, and are held in place by workers until a lifting force is applied to the bridle and hooks by means of a lifting cable. After this lifting force has been applied the hooks will usually remain in place during lifting since the hooks are urged in angulated relation to the pipe by means of the lifting bridle.

Since the hooks must be manually retained in proper position as lifting force is applied, obviously the workers involved are subjected to considerable danger especially at the initial portion of the lifting operation. Since workers must hold the hooks in place in the pipe ends until lifting begins, the hands of many workers have been injured when lifting forces are applied to bridle and hook assemblies, especially when the hands of the workers are improperly positioned or under circumstances when the lifting hooks slip. It is desirable therefore to provide a pipe lifting and handling system whereby workers need not manually retain lifting mechanisms in place as lifting force is applied.

Another danger that frequently exists to the workers is the danger that the hooks will slip during a lifting operation, thereby allowing joints of pipe to be released and fall in the working area. Many workers have been injured and much property damages has resulted due to falling pipe. When pipe is being lifted or lowered in relation to pipe handling barges, such as when pipe and well casing are handled in relation to offshore well drilling rigs, the barge movement that occurs due to wave action simply compounds the severity of pipe handling problems and the danger to the workers involved. It is highly desirable that workers involved in such pipe handling operations be capable of positioning pipe lifting apparatus within pipe to be lifted and then withdrawing to a safe position during lifting of the pipe. It is also important to provide effective pipe handling apparatus that will not slip and allow the pipe to fall after being elevated.

Pipe such as drill stem and casing for well drilling and completion operations is typically threaded at the ends thereof to provide for connection of pipe joints to form pipe strings or casing strings. These threaded connections must remain undamaged during pipe handling and transportation operations because the pipe joints are required to withstand a significant amount of fluid pressure and the threads must form an efficient seal. When a pipe lifting hook slips and allows a section of pipe to fall even a few inches, the force of impact of the externally threaded ends of the pipe can severely damage the threads to the extent that the pipe joint must be returned to a manufacturing facility for rethreading operations. Further, internal pipe threads can be easily damaged if pipe lifting hooks slip during lifting. It is highly desirable therefore that pipe lifting and handling apparatus be capable of absolutely preventing pipe from falling or slipping during such handling operations. Obviously pipe handling hooks that are mechanically secured to the pipe during initial lifting and hoisting operations will greatly reduce the damage that might otherwise occur if the pipe were allowed to slip and fall. Moreover, protection for other equipment and personnel is materially enhanced if pipe lifting hooks are capable of being retained in positive mechanical assembly with the ends of pipe during all phases of lifting and handling operations.

SUMMARY OF THE INVENTION

It is a primary feature of the present invention to provide a novel pipe lifting hook mechanism having the capability of being clamped securely to the pipe during all phases of lifting and handling operations.

It is another feature of this invention to provide a novel pipe lifting hook mechanism incorporating a releasable friction gripping assembly that establishes frictional locking engagement with the pipe to thus prevent the hook mechanism from slipping or falling out of the pipe at any stage of lifting and handling operations.

It is an even further feature of this invention to provide a novel pipe lifting hook mechanism incorporating a frictional pipe gripping lock shoe that is pivotal to locking engagement with the pipe and which incorporates a reversible ratchet mechanism to thus enable the locking assembly to be retracted from the pipe when removal of the lifting hook is desired.

Among the several features of this invention is contemplated the provision of a novel pipe lifting hook mechanism that is usable in pairs and placed in frictionally retained assembly with the ends of the pipe and released by workers who may then move to a safe position as pipe lifting and handling operations are initiated.

It is another feature of the present invention to provide a novel pipe lifting hook mechanism that is safe to use and which is simple in nature, reliable in use and low in cost.

Briefly, a clamping type pipe lifting and handling mechanism according to the present invention incorporates a generally "C" shaped hook having an upper elongated hook portion from which extends a hook lifting eye that may be attached to a lifting cable or chain such as is typically utilized in lifting bridles for handling pipe and other elongated members. The hook structure also includes a lower elongated hook portion, which in the case of pipe, is inserted into the pipe to establish connection therewith. The hook structure also includes a transverse connecting portion which is preferably formed integrally with the upper and lower hook portions thus defining the "C" shaped form. A lifting plate is provided at the free extremity of the lower hook portion and is adapted for engagement with the internal surface of the pipe. The lifting plate functions to distribute forces between the hook and pipe structure.

An elongated shaft is maintained in rotatable relation with the upper hook portion and is oriented in generally normal relation therewith. A pair of shoe support legs extend in spaced relation from the rotatable shaft and are provided with grip shoes at the free extremities thereof. The grip shoes are movable upon rotation of the shaft and legs into frictional locking engagement with the upper surface portion of the pipe immediately above the lift plate. In order to insure locking of the grip shoes in engagement with the pipe to thus prevent inadvertent release of the grip shoes, the rotatable shaft is controlled by means of a reversible ratchet mechanism that allows unidirectional rotation of the shaft depending upon the selected position of the ratchet mechanism. The ratchet mechanism is manually selectable to control the direction of allowable rotation of the shaft and leg supported grip shoes.

BRIEF DESCRIPTION OF THE DRAWINGS

So that the manner in which the above recited features, advantages and objects of the present invention are attained and can be understood in detail, more particular description of the invention briefly summarized above may be had by reference to the embodiment thereof which is illustrated in the appended drawings, which drawings form a part of this specification.

It is to be noted, however, that the appended drawings illustrate only a typical embodiment of this invention and are therefore not to be considered limiting of its scope, for the invention may admit to other equally effective embodiments.

IN THE DRAWINGS

FIG. 1 is a side elevational view of a clamping type lifting hook mechanism for pipes and the like which is constructed in accordance with the present invention and which shows alternative positioning of the grip shoe portion thereof by means of broken lines.

FIG. 2 is a transverse sectional view taken along line 2—2 of FIG. 1 which illustrates the internal ratchet mechanism of the apparatus by way of broken lines.

FIG. 3 is a top view taken along line 3—3 of FIG. 1 and which illustrates the brace and ratchet portions of the apparatus and also showing an alternative frictional engaging lifting rod.

DETAILED DESCRIPTION OF THE PREFERRED EMBODIMENT

Referring now to the drawings and first to FIG. 1, a pipe lifting and handling hook of the clamping type is shown generally at 10 and incorporates a hook 12 having an upper elongated portion 14 defining a free extremity 16. A lifting eye 18 is connected to the upper hook portion 14 adjacent the free extremity 16. Lifting eye 18 may be formed integrally with the hook portion if desired or, in the alternative, may be attached to the upper hook portion 14 by any suitable means without departing from the spirit and scope of the present invention. The hook 12 also incorporates a lower elongated portion 20 defining a free extremity 22 which is provided with a lift plate 24. The lift plate is adapted to engage the inner surface portion of a pipe to be lifted. The lift plate 24, if desired, may be formed to define a curved upper surface that conforms to the curvature of the pipe to be lifted, thus functioning to evenly distribute the forces of lifting between the lifting hook and the pipe being lifted.

As shown in the alternative view of FIG. 2, the lift plate may include an arcuate friction pad 23 which is secured to the metal lift plate 24 by means of screws 25 or other suitable means of attachment. The friction pad 23 provides additional protection against slipping due to its frictional, form-fitting engagement with the inner surface of the pipe during lifting.

The hook structure 12 also incorporates a transverse connection portion 26 which interconnects the upper and lower elongated portions 14 and 20. If desired, the transverse connection portion 26 may be formed integrally with the upper and lower hook portions or, in the alternative, may be structurally interconnected with the upper and lower hook portions in any desirable manner. The transverse connection portion 26 is shown to be of generally linear form and disposed in substantially normal relation with the upper and lower hook portions, thus maintaining the upper and lower hook portions in substantially parallel relation. It is intended, however, that the transverse portion 26 may be of any suitable design, such as completely curved for example, without departing from the spirit and scope of this invention.

As mentioned above, it is desirable that the pipe lifting hook 10 be capable of being locked in assembly with the pipe to prevent improper positioning of the hook on the pipe as it is lifted and to also prevent the hook from inadvertently releasing the pipe during the various phases of lifting and handling operations. In accordance with the present invention the pipe lifting hook mechanism 10 incorporates frictional locking features that allow workers to manually place the hook mechanism at its proper position relative to the pipe and then lock it in place. The hook mechanism will be retained in its proper position by the frictional locking features until lifting operations begin, thereby allowing the workers to withdraw to a safe position as the pipe is lifted and handled.

The frictional locking features are evident in FIGS. 1, 2 and 3, which disclose a brace element 28 that is fixed to the underside of the upper elongated portion 14 of the hook 12 such as by welding or by any other suitable means of attachment. The brace may also be integral with the hook if desired. As shown particularly in FIGS. 2 and 3, brace 28 is formed to define an internal ratchet keyway 30 which is disposed in substantially normal relation with respect to the upper elongated portion 14 of the hook. An elongated shaft 32 extends through the keyway 30 and includes a central portion 34 in the form of a key which thereby permits ratchet controlled rotation of the shaft 32 relative to the brace 28. At one extremity of the shaft 32 is provided a connector element 36 having an internally threaded opening 38 that receives the threaded extremity of the shaft 32. A shoe support leg 40 extends from the connector element 36 and is provided with a shoe support member 42 at the free extremity of the leg. The shoe support member 42 is fixed to the leg 40 and supports a friction pad 44 that is adapted for frictional engagement with the external cylindrical surface of the pipe to be lifted. On the opposite side of the brace element 28 a second shoe support leg 46 is provided which extends in nonrotatable relation with the shaft 32. The shoe support leg 46 also supports a pad support member 48 in immovable relation therewith. The pad support member in turn supports a friction pad 50 that is provided for frictional engagement with the outer surface of the pipe. The shoe support legs 40 and 46 are oriented in substantially parallel relation and are simultaneously rotatable along with rotation of the shaft 32. Thus, as shown in FIG. 1, the shoe support legs and friction pads may be rotated from the locked position shown in full line to an unlocked position as shown in broken line. In the locked position the frictional pads 44 and 50 are maintained in frictional gripping engagement with the outer cylindrical surface of the pipe. This frictional gripping engagement secures the hook member 10 in positive, immovable assembly with the pipe to thereby restrain it in place until such time as lifting operations begin. After placing the hook assembly in gripping engagement with the pipe, the workers may then withdraw to a safe position while lifting operations are conducted. The frictional pad 23 of the lifting plate is capable of being deformed by mechanical pressure, thus enabling it to conform to the inner surface of the pipe. The frictional pad 23 augments the frictional gripping capability of the lifting hook mechanism.

The shaft 32 is provided with a reversible ratchet head 52 having a selector element 54 that may be manipulated by the workers to control the direction of rotation of the shaft and shoe support legs relative to the brace portion of the hook. When the shoe support legs maintain the friction pads in locked assembly with the pipe, such as in the position illustrated in full line in FIG. 1, the ratchet selector element 54 will be positioned to prevent counterclockwise movement of the shoe positioning shaft 32. This will prevent the hook member from inadvertently slipping from the pipe. When it is desired to release the hook member from the pipe, the ratchet selector element 54 is simply repositioned so that the shaft 32 and shoe support legs will pivot in the proper direction. By simply applying a pulling force to the pipe lifting hook, the frictional force that is developed between the friction pads and the pipe will then allow rotation of the shaft 32 thus permitting ready removal of the hook mechanism from the pipe. The friction pads 23, 44 and 50 may be composed of any suitable resilient friction material such as rubber, synthetic rubber and the like having the capability of compensating for minor structural differences in the pipe to thus permit use of the hook mechanism with pipe of various sizes.

The lifting eye 18 is attached to the upper elongated portion 14 of the hook 12 between the pivot point or axis of the shaft 32 and the free extremity 16 of the upper elongated portion. By so positioning the lifting eye, forces applied by lifting cables or chains to the lifting eye will tend to move the hook mechanism further into the pipe. The frictional type clamping mechanism of this invention functions to insure that the hook structure does not tend to move toward a pipe releasing direction after the hook mechanism has been brought into assembly with the pipe. The hook mechanism may be removed from the pipe only by properly positioning the ratchet selector element 54 to thus permit the shaft 32 to rotate in the proper direction for release of the pipe.

The elongated lower portion 20 of the hook 12 provides that the lift plate 24 is sufficiently offset from the end portion of the pipe as to clear any internal threads at the internally threaded extremity of the pipe. Further, this feature insures that forced transmission between the pipe and the hook occurs at a distance substantially removed from the extreme ends of the pipe.

In view of the foregoing, it is clearly evident that the present invention is one well adapted to attain all of the objects and advantages hereinabove set forth, together with other objects and advantages that are inherent from a description of the apparatus itself.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof, it is to be understood that all matters hereinabove set forth or shown in the accompanying drawings are to be interpreted as illustrative and not in any limiting sense.

What is claimed is:

1. A locking hook mechanism for lifting and handling joints of horizontally oriented pipe such as oil well casing, comprising:

(a) a generally "C" shaped hook member having an elongated lower piper support portion being insertable within one end of a horizontally positioned joint of pipe and having upwardly directed supported engagement with the inner surface of said joint of pipe, said hook member having an elongated upper portion interconnected with said lower pipe support portion and being positioned in spaced relation relative to said lower pipe support portion;

(b) lifting connection means being provided at said upper portion of said hook member at a position above the location of engagement of said pipe support portion with said inner pipe surface, said lifting connection means being connectable to lifting apparatus; and (c) grip shoe means being movably secured to said upper portion of said hook member and being movable from a released position out of contact with said pipe to a locked position in frictional locking engagement with the outer surface of said joint of pipe, said grip shoe means establishing only sufficient frictional engagement with said outer pipe surface to retain said locking hook mechanism in assembly with said pipe in the absence of lifting force.

2. A locking hook mechanism as recited in claim 1, wherein:

said grip shoe means incorporates at least one frictional grip pad being pivotally movable from said release position to said locked position.

3. A locking hook mechanism as recited in claim 1, wherein:

lock means selectively locks said grip shoe means at said locked position thereof to prevent inadvertent disassembly of said clamping hook mechanism from said pipe, said lock means being manually manipulatable to release said lock means and permit movement of said grip shoe means toward said released position thereof.

4. A locking hook mechanism as recited in claim 3, wherein said lock means comprises:

(a) ratchet means movably coupling said grip shoe means for pivotal movement relative to said hook member; and (b) ratchet selector means extending from said ratchet means and being manually positionable to selectively control the direction of allowable rotation of said grip shoe means.

5. A locking hook mechanism as recited in claim 1, wherein said grip shoe means comprises:

(a) support shaft means being rotatably coupled with said upper portion of said hook member;

(b) a pair of shoe support legs extending transversely from said support shaft means and being disposed in spaced relation; and (c) gripping shoe means being attached to each of said shoe support legs and positioned for frictional gripping engagement with the outer surface of said pipe.

6. A locking hook mechanism as recited in claim 5, wherein said support shaft means comprises:

(a) means defining a ratchet keyway;

(b) means defining a ratchet key being movably received within said keyway, said shoe support legs being connected in spaced generally parallel non-rotatable relation with said ratchet key; and (c) a reversible ratchet head being connected to said ratchet key and being selectively positionable to control the direction of relative rotation of said ratchet key within said ratchet keyway.

7. A locking hook mechanism as recited in claim 1, wherein brace means is fixed to the underside of said upper portion of said hook member and said grip shoe means comprises:

(a) shaft means being rotatably secured to said brace means;

(b) a pair of shoe support legs extending from said shaft means on either side of said brace means and being positioned in generally parallel relation; and (c) said pair of friction shoes being supported by said shoe support legs and being pivotally movable into frictional gripping relation with the outer surface of said pipe.

8. A locking hook mechanism as recited in claim 7, including:

ratchet means securing said shaft means in selectively controlled pivotal relation with said brace means, said ratchet means being selectably positionable to control selected rotation of said shaft means relative to said brace means toward said locked and released positions thereof.

9. A locking hook mechanism as recited in claim 7, wherein said friction shoes comprise:

(a) shoe support members being fixed to each shoe support leg; and (b) resilient friction pads being secured to each of said shoe support members.

10. A locking hook mechanism as recited in claim 1, wherein:

lift plate means is provided at the upper side of said lower portion of said hook member, said lift plate means is engageable with the inner surface of said pipe and distributes the force between said hook member and said pipe.

11. A locking hook mechanism as recited in claim 10, wherein:

friction pad means is secured to said lift plate means and is positioned for engagement with the inner surface of pipe being lifted, said friction pad means being of curved upper configuration.

12. A locking hook mechanism as recited in claim 11, wherein:

said friction pad of said lifting plate is composed of a deformable frictional material capable of conforming to the inner surface of pipe being lifted.

13. A locking hook mechanism as recited in claim 1, wherein said lower portion defines a free extremity, wherein:

(a) a pipe lifting plate extends upwardly from the free extremity of said elongated lower portion for engagement with said inner surface of said pipe at a position spaced from the extremity of the pipe within which it is positioned; and (b) said grip shoe means is positioned for contact with the outer surface of said pipe at a position substantially opposed with a position of contact by said pipe lifting plate with the inner surface of said pipe.

14. A locking hook mechanism as recited in claim 1, wherein:

(a) said elongated upper portion of said hook member has a length at least as great as the length of said lower elongated portion and defines a free extremity; and (b) said lifting connection means is located on said elongated upper portion at a position near said free extremity.

* * * * *